US007553043B2

(12) United States Patent
Venn

(10) Patent No.: US 7,553,043 B2
(45) Date of Patent: Jun. 30, 2009

(54) LIGHT EMITTING APPARATUS FOR USE IN A CONTAINER

(76) Inventor: Curtiss M. Venn, 881 Tenth Ave., Apt. 3A, New York, NY (US) 10019

( * ) Notice: Subject to any disclaimer, the term of this patent is extended or adjusted under 35 U.S.C. 154(b) by 9 days.

(21) Appl. No.: 11/682,543

(22) Filed: Mar. 6, 2007

(65) Prior Publication Data

US 2008/0218997 A1 Sep. 11, 2008

(51) Int. Cl.
*A45C 15/06* (2006.01)

(52) U.S. Cl. ..... 362/156; 362/84; 362/103

(58) Field of Classification Search ..... 362/154, 362/155, 156, 84, 103, 105, 106
See application file for complete search history.

(56) References Cited

U.S. PATENT DOCUMENTS 2,288,996 A * 7/1942 Dubilier ..... 150/150
3,808,416 A * 4/1974 Pottratz ..... 362/156
5,067,063 A 11/1991 Granneman et al.
5,073,844 A * 12/1991 Coyner et al. ..... 362/156
5,245,517 A * 9/1993 Fenton ..... 362/156
5,268,827 A 12/1993 Granneman et al.
5,444,605 A * 8/1995 Rivera ..... 362/156
5,475,574 A * 12/1995 Chien ..... 362/108
5,580,663 A 12/1996 Campisano et al.
5,676,451 A * 10/1997 Tabanera ..... 362/156

(Continued)

OTHER PUBLICATIONS

Electroluminescence, from Wikipedia, last modified Oct. 26, 2006 (3 sheets).

(Continued)

*Primary Examiner*—Sandra L O'Shea
*Assistant Examiner*—Gunyoung T Lee
(74) *Attorney, Agent, or Firm*—Hoffmann & Baron, LLP

(57) ABSTRACT

The present invention includes an apparatus for illuminating an inner portion of a container. The apparatus includes a first electroluminescent lamp for emitting light within the container. Also, the apparatus includes a holding member for stabilizing the position of the lamp within the container. The holding member includes a first lamp retaining portion secured to the first electroluminescent lamp. Additionally, the holding member includes an extending portion continuous with the first lamp retaining portion. The extending portion has a width and a length defining a surface for engaging an inner portion of the container. Further, at least a portion of the length of the extending portion is remote from the retaining portion.

20 Claims, 7 Drawing Sheets

U.S. PATENT DOCUMENTS

| | | | | |
|---|---|---|---|---|
| 5,836,671 | A * | 11/1998 | Chien | 362/84 |
| 5,947,584 | A | 9/1999 | Passanante et al. | |
| 6,082,867 | A | 7/2000 | Chien | |
| 6,120,162 | A * | 9/2000 | Guerrieri | 362/155 |
| 6,132,059 | A * | 10/2000 | Leibowitz | 362/156 |
| 6,152,572 | A | 11/2000 | Cutler | |
| 6,158,872 | A * | 12/2000 | Rodgers | 362/156 |
| 6,213,616 | B1 | 4/2001 | Chien | |
| 6,253,489 | B1 * | 7/2001 | Sung et al. | 47/65.7 |
| 6,485,159 | B2 * | 11/2002 | Pitts | 362/84 |
| 6,499,857 | B1 * | 12/2002 | Lumley | 362/154 |
| 6,585,390 | B2 * | 7/2003 | Stone et al. | 362/156 |
| 6,637,909 | B1 | 10/2003 | Bryan | |
| 6,824,291 | B2 | 11/2004 | Vautrin et al. | |
| 6,922,020 | B2 | 7/2005 | Pennaz et al. | |
| 7,246,915 | B2 * | 7/2007 | Verona | 362/156 |
| 2005/0007765 | A1 | 1/2005 | Easley | |
| 2005/0013128 | A1 | 1/2005 | Worthington | |
| 2005/0219839 | A1 | 10/2005 | Branson | |
| 2005/0281019 | A1 | 12/2005 | Verona | |

OTHER PUBLICATIONS

Lumi-Sheet, Fuji & Co. (Piezo Science), Last modified: Jun. 18, 2005 (2 sheets).

* cited by examiner

LIGHT EMITTING APPARATUS FOR USE IN A CONTAINER

BACKGROUND OF THE INVENTION

The present invention relates to an apparatus for illuminating the inside of a closed space and particularly a container, such as a handbag, backpack, luggage, box, or other receptacle.

While various methods have been devised to illuminate the inside of containers, many require bulky or cumbersome lamp assemblies that take-up too much room and/or are a little too heavy to carry in a portable container.

More recently, electroluminescent (EL) materials have been developed that can be formed into a thin sheet and used as part of a portable light source. U.S. Pat. No. 6,922,020 to Pennaz et al. and U.S. Pat. No. 5,580,663 to Campisano et al. both describe EL materials and methods of forming them, which are incorporated herein by reference. Generally, electroluminescence is the result of a radiative recombination of electrons passing through a semiconductor. The excited electrons release their energy as photons or light. Contemporary applications of EL materials as a light source inside a container still either generally include a bulky assembly or require the lamp to be permanently secured to the container. However, many people do not like to permanently alter expensive or delicate containers. Also, some containers are just not suited for such bulky or permanent installations.

Thus, it is desirable to provide an illuminating apparatus which overcomes the shortcomings found in the art of lamp assemblies as set forth above while also providing improved structural and operating features.

SUMMARY OF THE INVENTION

The present invention includes an apparatus for illuminating an inner portion of a container. The apparatus includes a first electroluminescent lamp for emitting light within the container. Also, the apparatus includes a holding member for stabilizing the position of the lamp within the container. The holding member includes a first lamp retaining portion secured to the first electroluminescent lamp. Additionally, the holding member includes an extending portion continuous with the first lamp retaining portion. The extending portion has a width and a length defining a surface for engaging an inner portion of the container. Further, at least a portion of the length of the extending portion extends away from the retaining portion.

Additionally, the above mentioned apparatus can alternatively include additional elements and features. In particular, the holding member can include a second lamp retaining portion for attaching a second electroluminescent lamp. Thus, the second end of the extending portion can be attached to the second lamp retaining portion. Also, the holding member can either be formed of a rigid or generally pliable material. Further, with regard to the extending portion, it can be integrally formed with the lamp retaining portion. Also, the length of the extending portion can have a curved cross-section. Further, the extending portion can include a proximal end secured to and continuous with the first lamp retaining portion and a distal end remote from the first lamp retaining portion. Yet further, the extending portion of the apparatus can include at least one pivotal portion for adjusting the shape of the holding member. Further still, the extending portion can include a portion that narrows. Additionally, the extending portion can be detachable secured to at least the first lamp retaining portion. Also, the apparatus can generally include a power source and switch, wherein at least one of the power source and the switch are secured to the holding member.

Another aspect of the present invention, includes an apparatus for illuminating the inside of a receptacle. The apparatus includes a generally planar flat panel lamp. Also, the apparatus includes at least one switch for controlling the lamp, and which is coupled to the lamp. Further, the apparatus includes a power source coupled to both the lamp and the switch. Additionally, the apparatus includes a base member attached to the lamp. The base member includes an extending portion, wherein at least a part of the extending portion curves away form the plane of the lamp.

Another aspect of the present invention, includes an illuminated container. The container includes a light emitting apparatus including a first electroluminescent lamp and a holding member for stabilizing the position of the lamp within the container. The holding member includes a lamp retaining portion and an extending portion. The first lamp retaining portion being secured to the first electroluminescent lamp. The extending portion being continuous with the first lamp retaining portion. Also the extending portion having a width and a length defining a surface for engaging an inner portion of the container. Additionally, at least a portion of the length of the extending portion is remote from the retaining portion. The light emitting apparatus being disposed at least partially within the container. Further including a container for holding the light emitting apparatus at least partially therein.

Additionally, the above mentioned apparatus can alternatively include additional elements and features. In particular, at least a portion of the container can include a light emitting portion for allowing light to emit from the container. The light emitting portion can include an aperture and/or a transparent section. Also, the light emitting portion can form a shape that is recognizable to an observer from the outside of the container. The shape can include at least one of a pattern, ornamental design and at least one letter or number.

As a result of the present invention an apparatus is provided for illuminating the inside of a closed space that is lightweight, portable, easy to install and effectively illuminates the inside of container.

These and other objectives, features, and advantages of this invention will become apparent from the following detailed description of illustrative embodiments thereof, which is to be read in connection with the accompanying drawings.

DETAILED DESCRIPTION OF THE INVENTION

The present invention relates to a lamp assembly for illuminating the inside of a closed space. The lamp assembly is intended for use inside a container, although it could also be used as a general purpose portable lamp. It preferably has a small profile that conforms to one or more inner surfaces of a handbag, backpack, luggage, briefcase or similar container. However, as with many light-weight portable devices, it could be used to illuminate any container or even as a general purpose lamp. Having an electroluminescent material as its light source, allows the overall lamp assembly to be formed into a thin web or sheet. Also, the electroluminescent material provides a plane or sheet of light, rather than a solitary point of light, as with a light bulb. A point light source creates shadows in regions linearly blocked from that point of light, namely by an obstructing object. In contrast, a planar light source illuminates from many angles and thus eliminates those shadows that would have been created by other light sources.

With reference to the drawings, FIGS. 1*a*-1*d* show a lamp assembly 100 including a holding member 110 in accordance with an embodiment of the present invention. The holding member 110 is preferably formed as a thin sheet or web of semi-rigid material capable of retaining its shape. As shown more particularly in FIG. 1*c*, the holding member 110 has a generally J-shaped cross-section.

Part of the holding member 110 includes a generally planar portion 120 which is provided for retaining a sheet of electroluminescent (EL) material or lamp 150. The lamp 150 preferably covers a substantial part of the retaining portion 120. Although the lamp 150 is shown having a generally square shape, it should be understood that such material could be formed into many shapes and sizes as desired.

Figure 1B:
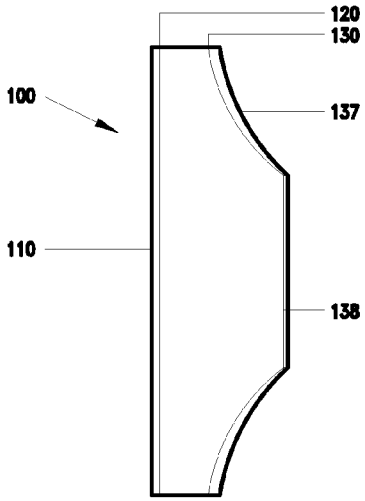
FIGS. 1*a*-1*d* are perspective, top, side and front views, respectively, of a lamp assembly in accordance with the subject invention.
Figure 1A:
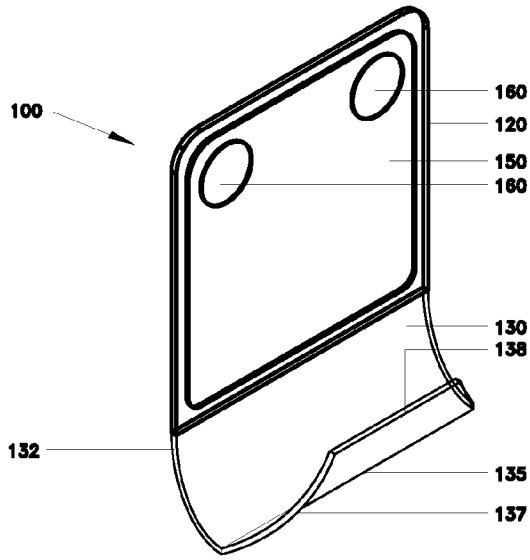
Figure 1C:
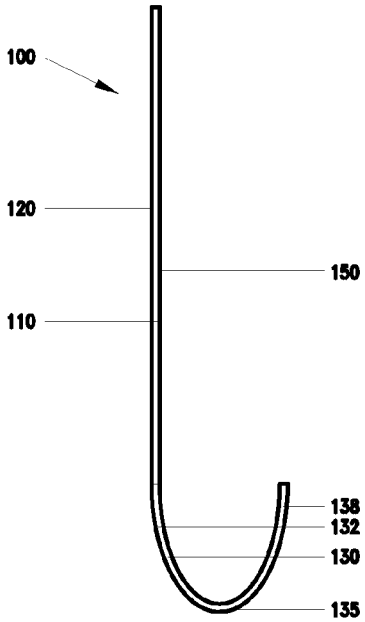
Figure 1D:
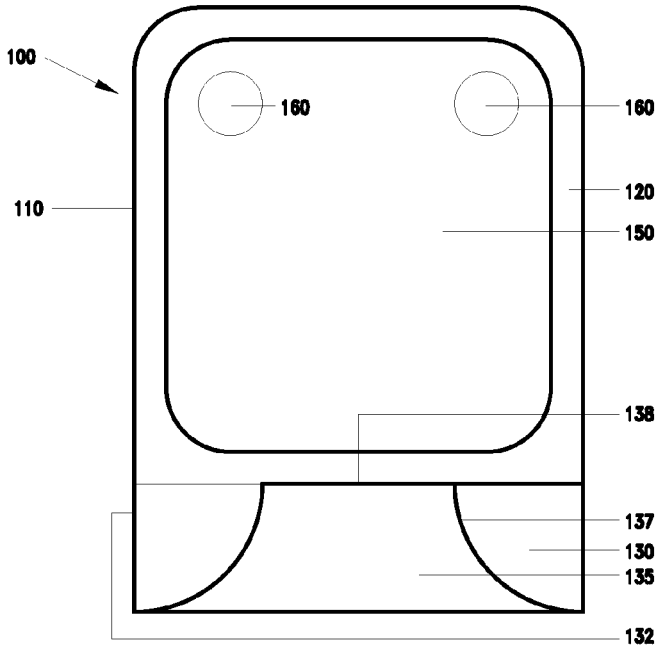
Figure 2B:
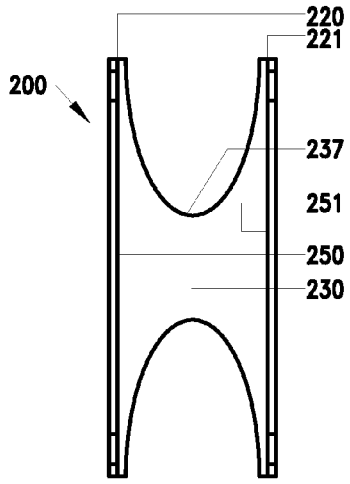
FIGS. 2*a*-2*d* are perspective, top, side and front views, respectively, of an alternative lamp assembly in accordance with the subject invention.
Figure 2A:
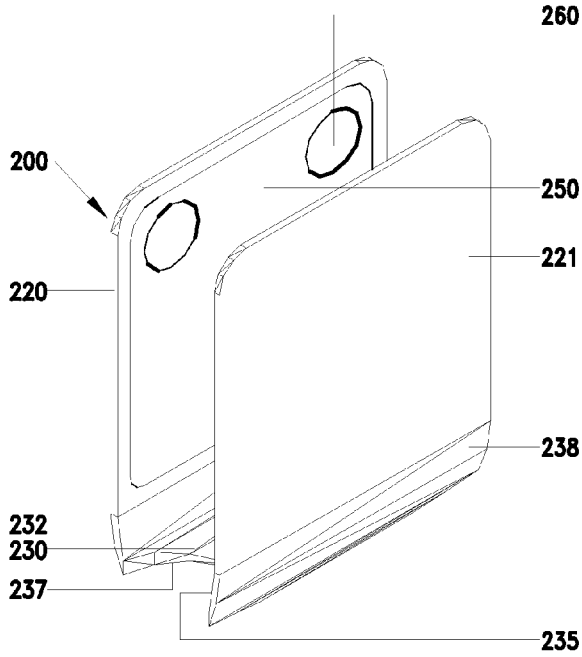
Figure 2C:
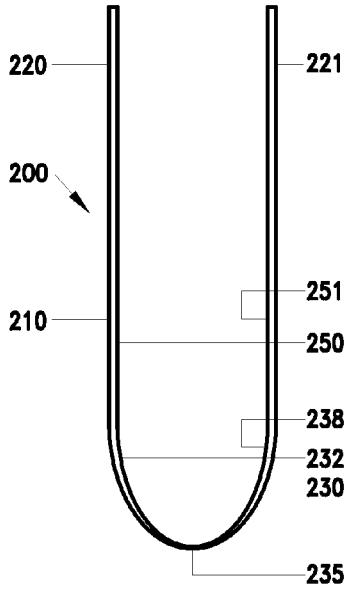
Figure 2D:
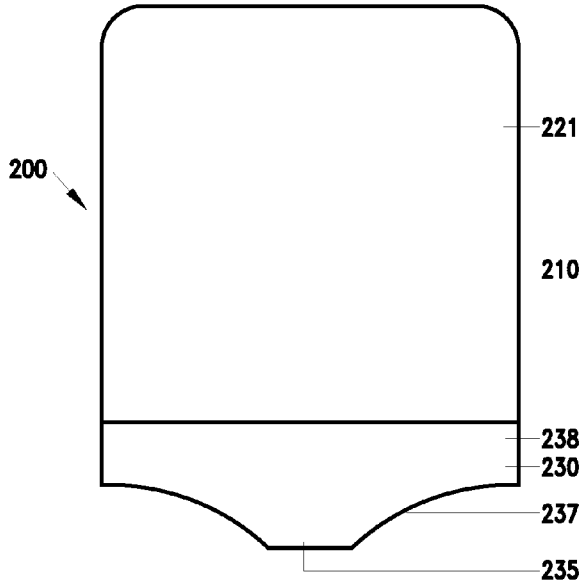

Additionally, the retaining portion also preferably holds control switches 160 that can turn power on/off or perhaps control other functions of the device. Although FIGS. 1*a* and 1*d* show two control switches 160, it should be understood that any number of control switches can be provided to suit the number of user controls incorporated into the device. Also, a variety of controls could be provided in addition to a standard on/off switch. For example, one switch could be a continuous on/off, while the other can turn the light on and automatically turn off after a pre-selected length of time. Also, switches can be provided to modulate color or the intensity of the light. Additionally, the control switches 160, shown in FIGS. 1*a* and 1*d*, are in the form of buttons that protrude through and are located in cut-outs in the EL material 150. However, due to the flexible nature of El material 150, alternatively the control switches 160 could lie beneath the surface of the EL material 150, thus eliminating the need for a cut-out in the EL material 150. In this way, the user could depress the EL material 150 over a control switch 160 in order to operate the switch 160.

The power source and wiring (neither of which are shown in FIGS. 1*a*-1*d*) for the lamp 150 are preferably contained within holding member 110. While it is preferred that the lamp assembly 100 be powered by low profile batteries that can be held within or attached to holding member 110, it should be understood that a tethered external battery pack could alternatively be used.

Part of the holding member 110 includes an extending portion 130 which is continuous with the retaining portion 120, but not necessarily planar. Preferably, the holding member 110 is formed as a unitary member that includes portions 120, 130. However, the two portions 120, 130 could be separately formed and made to join. Extending portion 130 preferably curves out of the plane of the retaining portion 120, such that curved portion 135 forms the bottom hook of the J-shape. Also, the extending portion 130 has a first end 132 and a second end 138. The first end 132 is adjacent retaining portion 120. Further, the extending portion 130 includes tapered edges 137 so that the width of the extending portion 130 tapers from the first end 132 to the second end 138. While the tapered edges 137 are shown with a curved taper, it should be understood that such a taper could be linear, stepped or a more unique stylized shape. Alternatively, the extending portion 130 need not taper at all or it could flare out wider than retaining portion 120.

Extending portion 130 serves various functions including a support surface, a handle and even a fastening element for the lamp assembly 100. As a support surface, the extending portion 130 is intended to engage at least a portion of the inner surface of a container to help retain the lamp assembly 100 in a relatively fixed position within the container. Also, extending portion 130 serves as a natural handle for the lamp assembly 100. Additionally, as discussed further below, extending portion 130 could be used as a hood or retainer, engaging an inner pocket or fastener on/in the container with which it is used.

The holding member 110 and others described herein preferably have a thin profile in order to minimize the bulk of the overall lamp assembly 100. The same hold true for the EL material 150, wiring and power source (not shown). It is also preferred that the overall dimensions of the holding member be such that it is easy to transport and fits into a small container without greatly reducing the capacity of that container. Additionally, it is preferred that the holding member be formed from a light-weight material, such as a polymer, that can be molded as formed inexpensively. It is preferred that the material have sufficient rigidity to hold its intended form, such as a plastic material. Also, while the materials could be virtually any color, all or a portion of the holding member could be translucent or opaque as well. However, alternatively a more pliable composition could be used to allow the assembly to be bent or altered by a user, to conform to the inside of a specific container. For example, a thin sheet of pliable metal encased in rubber or flexible plastic would provide a material that could be bent or twisted as desired, and maintain that altered form.

The embodiment shown in FIGS. 2*a*-2*d* illustrate an alternative lamp assembly 200 with a holding member 210 that includes first 220 and second 221 lamp retaining portions. Thus, the first lamp retaining portion 220 holds a first EL lamp 250 and the second lamp retaining portion 221 hold a second EL lamp 251. In contrast to the first embodiment, this holding member 210 has a basic U-shape. It includes an extending portion 230 with a first end 232 attached to the first lamp retaining portion 220 and a second end 238 attached to the second lamp retaining portion 221. A curved portion 235 forms the bottom of the U-shape. This curved portion 235 can house or retain the battery, power and electronic circuitry. It should be noted that the width of the curved portion 235 is also provided with tapered edges 237 so that extending portion 230 is narrower at the bottom. However, as mentioned with regard to the first embodiment, alternatively extending portion 230 either need not include a tapered portion or could flare-out and be wider than retaining portions 220, 221. Also, as with the first embodiment discussed above, control switches 260 can be provided as needed.

Figure 3A:
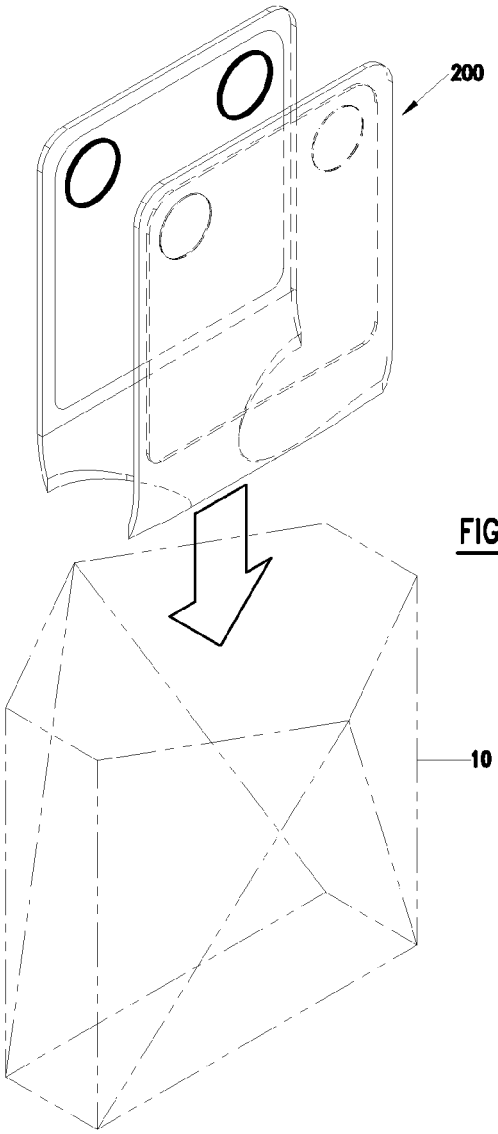
FIGS. 3*a*-3*b* are perspective views of the lamp assembly of FIGS. 2*a*-2*d* outside and inside a generic container, respectively (container shown in phantom lines).
Figure 3B:
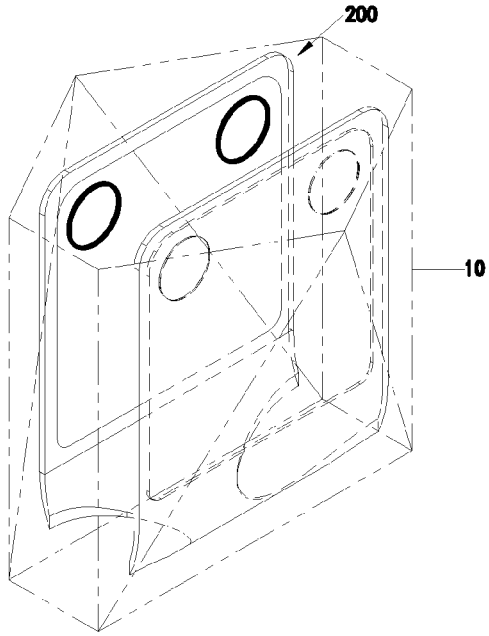

FIGS. 3*a* and 3*b* illustrate a preferred application of the lamp assembly 200 in combination with a generic container 10. As shown, lamp assembly 200 is preferably inserted into container 10 and covers the inner walls therein. It should be understood that extending portion 230 of holding member 210 could be formed differently to suit a container of a different size. Thus, a wider or narrower gap between the two retaining portions 220, 221 could accommodate a wider or narrower container respectively.

Figure 4A:
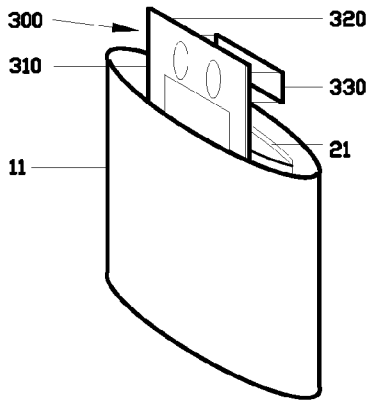
FIGS. 4*a*-4*b* are perspective views of a further alternative lamp assembly outside and inside a generic container, respectively.
Figure 4B:
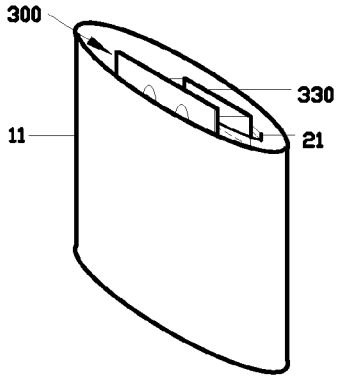
Figure 4C:
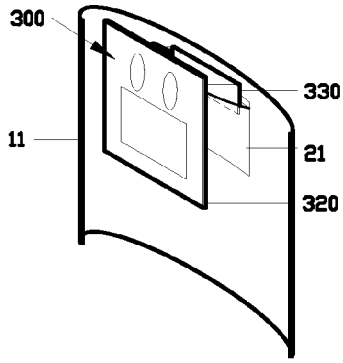

FIGS. 4*a*-4*c* show a further alternative lamp assembly 300 in being inserted into another generic container 11. The lamp assembly 300 has a holding member 310 that includes a retaining portion 320 and an extending portion 330. However, in contrast to the previous embodiments, rather than forming a continuous sheet or web, extending portion 330 protrudes from a center area of the back of the retaining portion 320. Thus, extending portion 330 is used as a hook to suspend the assembly 300 from an inner pocket 21 of the container 11.

Figure 5:
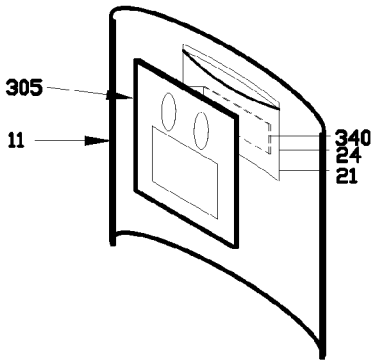
FIG. 5 is a perspective view of a further alternative lamp assembly and container, with the container in section.

FIG. 5 shows a lamp assembly 305 similar the lamp assembly 300, shown in FIGS. 4*a*-4*c*. However, lamp assembly 305 uses a fastening assembly 340 to stay secured to inner pocket 21. The fastening assembly 340 could be any number of known fastener combinations. For example fastening assembly 340 could comprise a hook, mating snaps, clips, magnets, Velcro (Velcro Industries B.V., Manchester, N.H.) or other similar fasteners. Additionally, in this and previous embodiments the substrate can include a plastic material with memory such that the material is pre-stressed as the device is compressed to fit within the container. Once placed inside the container the material's memory would forever press the device outwards towards the walls of the container. Also, the material could have formable areas strategically placed such that the formable material could engage seams of he container, for added stability.

Figure 6:
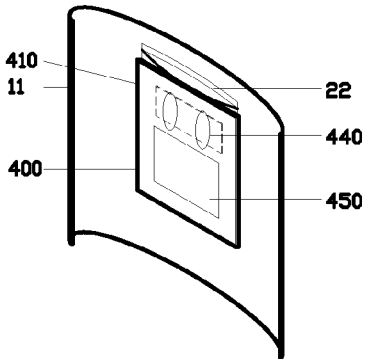
FIG. 6 is a perspective view of a yet a further alternative lamp assembly and container, with the container in section.

FIG. 6 shows a lamp assembly 400, similar to that of lamp assembly 305 in that it uses a fastening assembly 440 that works in combination with an inner surface 22 of the container 11, in a similar way to that of fastening assembly 340 referred to above. However, this embodiment does not include an extending portion. Instead, the holding member 410 includes a portion thereof for affixing the fastening assembly 440. As shown in FIG. 6, the fastening assembly 440 is preferably affixed on the side opposite the lamp 450.

Figure 7:
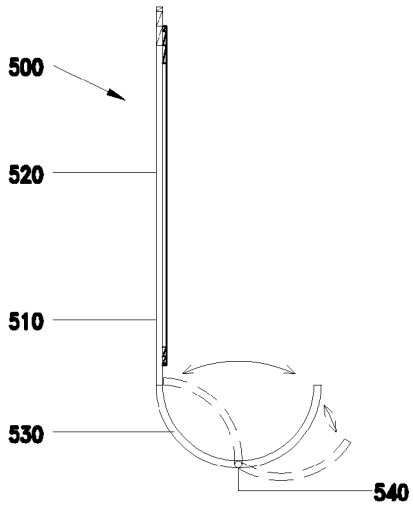
FIG. 7 is a side view of yet a further alternative lamp assembly in accordance with the subject invention.
Figure 8:
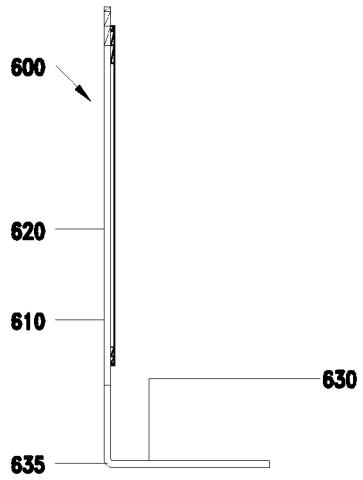
FIG. 8 is a side view of yet a further alternative lamp assembly in accordance with the subject invention.

FIGS. 7 and 8 illustrate alternative lamp assemblies 500, 600. The holding members 510, 610, have a similar configuration to lamp assembly 100 shown in FIGS. 1*a*-*d*, in that the lamp retaining portions 520, 620 are virtually the same. In contrast, extending portions 530, 630 show variations to the previously discussed design. In particular, extending portion 530, in FIG. 7, includes an added pivotal hinge 540 to provide adjustability to the configuration. Preferably, pivotal hinge 540 can be fixed in more than one position in order to hold a desired orientation. The hinge 540 also preferably pivots toward lamp retaining portion 520 and could thus be used to clip onto or fasten onto a surface inside a container or hook into a pocket, similar to that shown in FIGS. 4*a*-6. In FIG. 8, extending portion 630 provides more of an L-shaped configuration for the lamp assembly 600. In this embodiment, the curved portion 635 takes the form of a sharp bend in the holding member 610.

Figure 9:
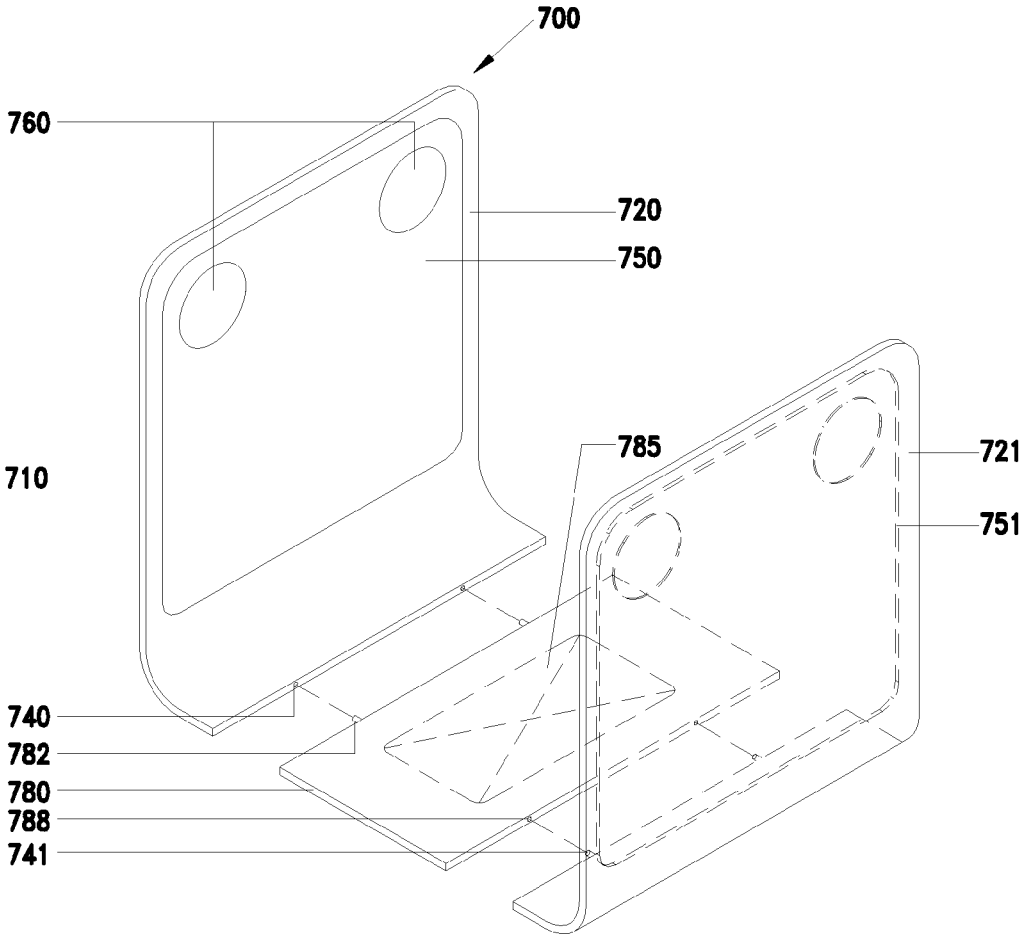
FIG. 9 is an exploded perspective view of yet a further alternative lamp assembly in accordance with the subject invention.

In a further alternative embodiment, FIG. 9 shows the lamp assembly 700 includes a modular holding member 710 that includes two lamp retaining portions 720, 721, with two lamps 750, 751, and an intermediate extender 780. While lamp assembly 700 is similar to the previously discussed U-shape embodiment, its modular aspect adds various features to the overall assembly. For example, a user could decide to only use one of the lamp retaining portions 720, 721, and perhaps not even use extender 780. Also, extenders 780 could be provided in different colors or sizes to help customize the assembly 700 to suit a user's preference or properly fit inside a particular container. Further, extender 780 could include wiring 782 and a battery 785 to power the assembly 700.

As a battery storage portion, the extender 780 is preferably easily replaced when the battery 785 runs out or needs to be recharged. Also, shown are connectors 740, 782, 788, 741 to provide a coupling between the extender and the lamps 750, 751. While connectors 740, 782, 788, 741 are in the form of a wire or pin and socket, it should be understood other known connectors could be used to join these elements. However, it is preferred that some connection be provided that transfers power from the extender 780 to the holding members 720, 721.

Figure 10A:
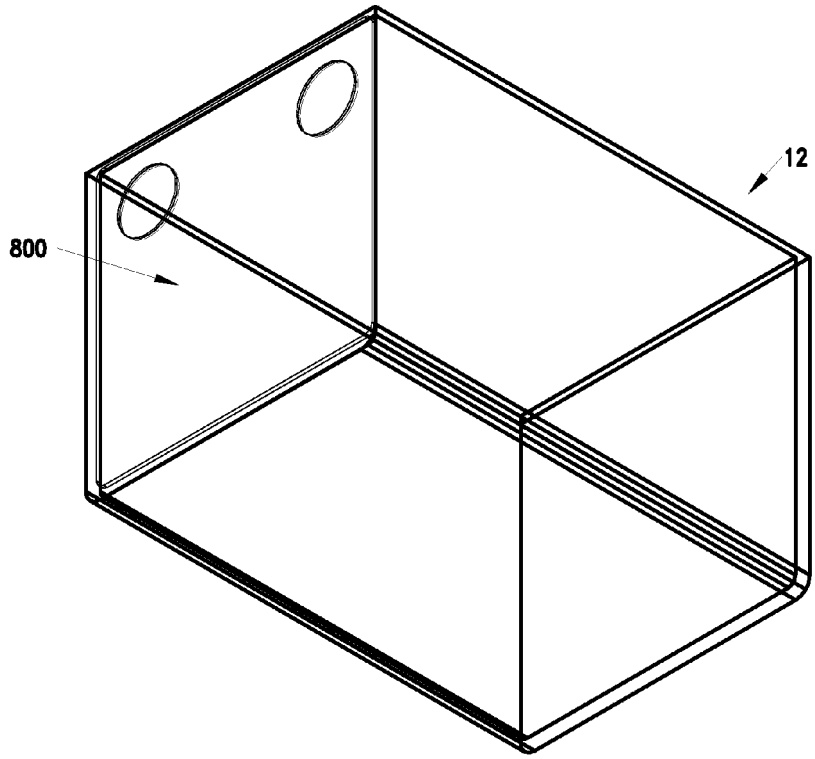
FIGS. 10*a* and 10*b* are perspective views of a further alternative lamp assembly used in conjunction with a container 12, which includes light emitting portions.
Figure 10B:
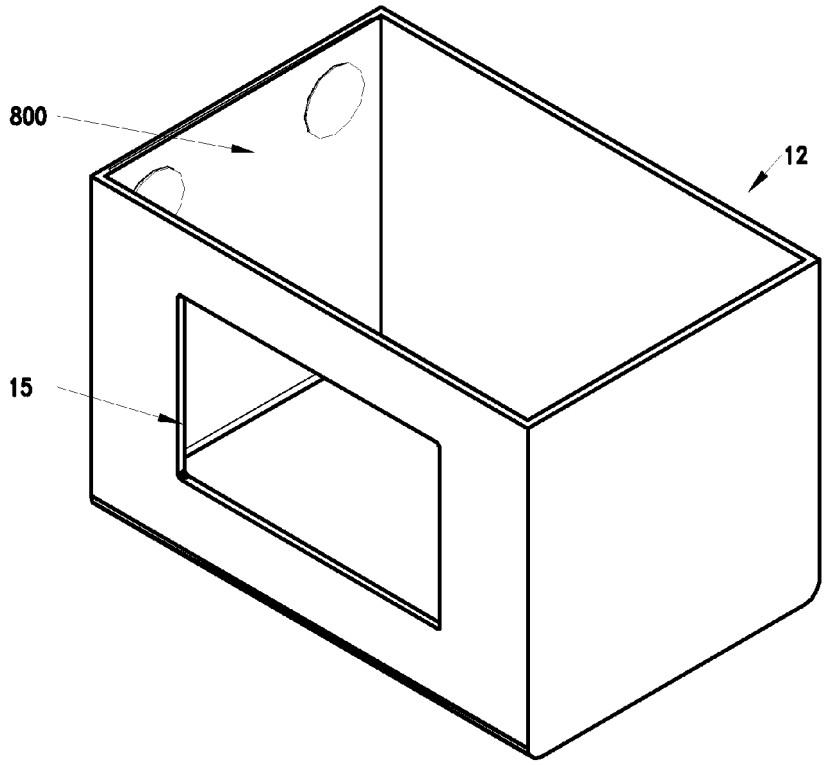

In a further alternative embodiment, FIGS. 10*a* and 10*b* show a container 12 with lamp assembly 800. Preferably, container 12, shown in FIG. 10*a* is either completely transparent or includes transparent sections that allow the light from inside the container 12 to be visible from the outside of the container 12. FIG. 10*b* shows a variation of container 12 including an aperture 15. Aperture 15 preferably allows light emit inside the container 12 from assembly 800 to be visible outside the container 12. Additionally, such apertures 15 can be patterned to show illuminated cut-outs of text, logos, or ornamental designs. The visibility of the light from the exterior of the container 12 can be either an ancillary or primary purpose of including the internal lamp assembly within the container 12. As a further alternative, if the entire container 12 or at least substantial portions thereof are transparent, then the container 12 would thereby emit light.

Figure 11:
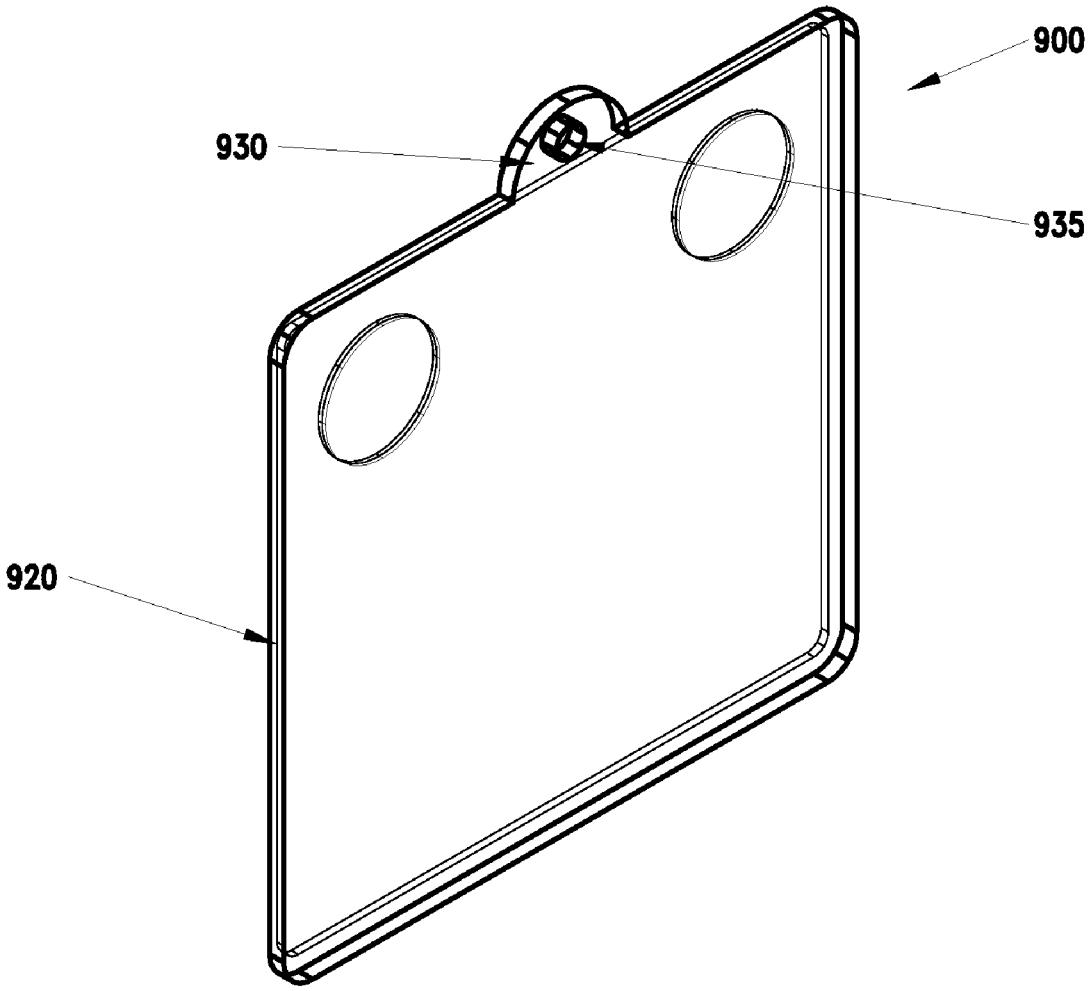
FIG. 11 is a top perspective view of a further alternative lamp assembly in accordance with the subject invention.

In yet a further alternative embodiment, FIG. 11 shows a lamp assembly 900 that includes an extending portion 930 protruding from a central upper edge of lamp retaining portion 920. It should be understood, however, that extending portion 930 could protrude from any one or more sides or edges of retaining portion 920. Further, assembly 900 could include more than one extending portion 930. Also, extending portion 930 can be larger or smaller than shown, as well as shaped differently. Additionally, extending portion 930 preferably includes an aperture 935, which can be used to secure the assembly 900 to a container. However, extending portion 930 could be constructed without such an aperture 935 or other known means of securing the assembly 900 to a container.

While various embodiments of the present invention are specifically illustrated and/or described herein, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. An illuminated container assembly comprising:

a container; and a light emitting apparatus including i) a first electroluminescent lamp ii) a switch for controlling said first electroluminescent lamp, said first electroluminescent lamp completely surrounding a peripheral edge of said switch and iii) a holding member for stabilizing a position of said lamp within said container, said holding member including a first lamp retaining portion and an extending portion, said first electroluminescent lamp secured on said first lamp retaining portion, and said extending portion being continuous with said first lamp retaining portion, said extending portion having a width and a length defining a surface for engaging an inner portion of said container, wherein at least a portion of said length is remote from said retaining portion, said light emitting apparatus removeably disposed at least partially within said container.

2. The assembly of claim 1, wherein at least a portion of said container includes a light emitting portion for allowing light to emit from said container, said light emitting portion including at least one of an aperture and a transparent section.

3. The assembly of claim 2, wherein said light emitting portion forms a shape that is recognizable to an observer from the outside of said container, wherein said shape includes at least one of a pattern, ornamental design and at least one letter or number.

4. The assembly of claim 1, wherein said light emitting apparatus further includes a power source secured to said holding member.

5. The assembly of claim 4, wherein at least a portion of said holding member is removeably secured from another portion of said holding member.

6. The assembly of claim 5, wherein the power source is secured to the removable portion of the holding member.

7. The apparatus of claim 4, wherein at least one connector transfers power between the extending portion and the first lamp retaining portion.

8. An apparatus for illuminating an inner portion of a container comprising:

a first electroluminescent lamp for emitting light within a container a switch for controlling said first electroluminescent lamp, said first electroluminescent lamp completely surrounding a peripheral edge of said switch; and a holding member for stabilizing a position of said lamp within said container, said holding member including i) a first lamp retaining portion, said first electroluminescent lamp disposed on said first lamp retaining portion, and ii) an extending portion continuous with said first lamp retaining portion, said extending portion having a width and a length defining a surface for engaging an inner portion of said container, wherein at least a portion of said length is remote from said retaining portion.

9. The apparatus of claim 8, wherein said length has a curved cross-section.

10. The apparatus of claim 8, wherein said extending portion is integrally formed with said lamp retaining portion.

11. The apparatus of claim 8, wherein said holding member includes a second lamp retaining portion for attaching a second electroluminescent lamp said second lamp retaining portion continuous with said extending portion and disposed remote from said first lamp retaining portion.

12. The apparatus of claim 11, wherein at least a portion of said width of said extending portion narrows.

13. The apparatus of claim 8, wherein said extending portion is detachably secured to said first lamp retaining portion.

14. The apparatus of claim 8, wherein said extending portion includes at least one pivotal portion for adjusting the shape of said holding member.

15. The apparatus of claim 8, wherein at least a portion of said holding member is capable of retaining its shape.

16. The apparatus of claim 8, wherein at least a portion of said holding member is formed of a generally pliable material.

17. The apparatus of claim 8, further comprising a power source said power source being secured to said holding member.

18. The apparatus of claim 13, wherein the extending portion and the first lamp retaining portion are coupled by mutually mating connectors.

19. The apparatus of claim 17, wherein the power source is disposed on said extending portion.

20. An apparatus for illuminating the inside of a receptacle comprising:

a first continuous sheet of electroluminescent material and a second continuous sheet of electroluminescent material, said first and second electroluminescent material disposed remote from one another;

at least one controlling switch coupled to at least one of said first and second electroluminescent material, said switch at least partially surrounded by one of said first and second electroluminescent material;

a first and second base member for removeably supporting said first and second electroluminescent material within said receptacle, each of said first and second base members including a retaining portion, wherein said first electroluminescent material is disposed on said first base member retaining portion and said second electroluminescent material is disposed on said second base member retaining portion, said first and second base members each also including an extending portion, said extending portion extending away from said retaining portion; and a power source retaining member coupled at opposed ends to said first and second base members, wherein a power source is disposed on said power source retaining member and said power source is coupled to both said first and second electroluminescent material.

* * * * *